US009416938B2

(12) United States Patent
Windom

(10) Patent No.: US 9,416,938 B2
(45) Date of Patent: Aug. 16, 2016

(54) INTEGRATED OPTIC AND BEZEL FOR FLASHLIGHT

(75) Inventor: Gregory David Windom, Portland, OR (US)

(73) Assignee: Coast Cutlery Co., Portland, OR (US)

( * ) Notice: Subject to any disclaimer, the term of this patent is extended or adjusted under 35 U.S.C. 154(b) by 0 days.

(21) Appl. No.: 13/490,348

(22) Filed: Jun. 6, 2012

(65) Prior Publication Data

US 2013/0329409 A1 Dec. 12, 2013

(51) Int. Cl.

| | |
|---|---|
| ***F21L 4/00*** | (2006.01) |
| ***F21V 5/04*** | (2006.01) |
| ***F21V 13/04*** | (2006.01) |
| ***F21V 14/02*** | (2006.01) |
| ***F21V 19/02*** | (2006.01) |
| *F21Y 101/02* | (2006.01) |
| *F21V 29/00* | (2015.01) |
| *F21V 5/00* | (2015.01) |

(52) U.S. Cl.

CPC . *F21V 5/04* (2013.01); *F21L 4/005* (2013.01); *F21V 13/045* (2013.01); *F21V 14/025* (2013.01); *F21V 19/02* (2013.01); *F21V 5/006* (2013.01); *F21V 29/20* (2013.01); *F21Y 2101/02* (2013.01); *Y10T 29/4998* (2015.01)

(58) Field of Classification Search

CPC ..... F21L 7/00; F21L 4/00; F21L 15/00; F21L 4/005; F21L 15/02; F21L 15/08; F21Y 2101/02

USPC ..... 362/171–174, 187, 190–191, 202–203

See application file for complete search history.

(56) References Cited

U.S. PATENT DOCUMENTS

| | | | | | |
|---|---|---|---|---|---|
| 1,778,039 | A | * | 10/1930 | Rogge | 362/187 |
| 3,717,759 | A | * | 2/1973 | Rousseau | 362/186 |
| 4,821,156 | A | * | 4/1989 | Siefert et al. | 362/187 |
| 4,841,417 | A | * | 6/1989 | Maglica et al. | 362/206 |

(Continued)

FOREIGN PATENT DOCUMENTS

| | | | |
|---|---|---|---|
| CN | 201145208 | Y | 11/2008 |
| CN | 101865362 | A | 10/2010 |

(Continued)

OTHER PUBLICATIONS

International Search Report and Written Opinion, issued in PCT Application No. PCT/US2013/043556, mailed Sep. 25, 2013, 12 pages.

(Continued)

*Primary Examiner* — Julie Bannan

(74) *Attorney, Agent, or Firm* — Schwabe Williamson & Wyatt

(57) ABSTRACT

Disclosed in various embodiments are integrated lens and bezel systems for a flashlight or other lighting unit. Various embodiments include a housing, including a bezel portion and a body portion, a lens, wherein the lens and the bezel together comprise a single, continuous component, and a light source disposed within the housing, wherein the light source is configured to interact with the lens to provide a light beam. Some embodiments provide a mechanism for adjusting the relative positions of the light source and lens, for example to allow for focusing of the light beam. In some embodiments, the lens is continuous with just the bezel portion, whereas in other embodiments, the lens, bezel, and all or part of the body portion are formed as a single, unitary component, for instance by injection-molding or co-molding.

18 Claims, 8 Drawing Sheets

(56) References Cited

U.S. PATENT DOCUMENTS

| | | | | |
|---|---|---|---|---|
| 5,904,414 | A * | 5/1999 | Monteleone et al. | 362/205 |
| 6,231,208 | B1 | 5/2001 | Dalton | |
| 6,536,923 | B1 | 3/2003 | Merz | |
| 6,547,423 | B2 | 4/2003 | Marshall et al. | |
| 7,349,163 | B2 | 3/2008 | Angelini et al. | |
| 7,461,945 | B2 | 12/2008 | Shiau | |
| 7,473,007 | B1 * | 1/2009 | Wang | 362/187 |
| 7,748,872 | B2 | 7/2010 | Holder et al. | |
| 8,152,327 | B2 | 4/2012 | Lewin et al. | |
| 8,371,710 | B2 | 2/2013 | Gupta et al. | |
| 8,485,683 | B2 * | 7/2013 | Popper et al. | 362/188 |
| 8,579,485 | B2 | 11/2013 | Hara | |
| 8,721,111 | B2 | 5/2014 | Yeh | |
| 2003/0189826 | A1 | 10/2003 | Yoon | |
| 2004/0190299 | A1 * | 9/2004 | Chapman | 362/394 |
| 2006/0109669 | A1 | 5/2006 | Tanaka | |
| 2006/0209558 | A1 | 9/2006 | Chinniah | |
| 2007/0189013 | A1 | 8/2007 | Ford | |
| 2007/0263390 | A1 | 11/2007 | Timinger et al. | |
| 2008/0068833 | A1 * | 3/2008 | Shiau | 362/187 |
| 2009/0109687 | A1 | 4/2009 | Householder et al. | |
| 2009/0225552 | A1 | 9/2009 | Chen | |
| 2009/0257230 | A1 | 10/2009 | Kah | |
| 2010/0172134 | A1 | 7/2010 | Moon | |
| 2010/0327302 | A1 | 12/2010 | Wang et al. | |
| 2011/0080725 | A1 * | 4/2011 | Brands et al. | 362/187 |
| 2011/0080736 | A1 | 4/2011 | Brands et al. | |
| 2012/0020062 | A1 | 1/2012 | Opolka | |
| 2012/0051063 | A1 | 3/2012 | Holder | |
| 2012/0218744 | A1 * | 8/2012 | Popper et al. | 362/184 |
| 2013/0027922 | A1 | 1/2013 | Chen | |

FOREIGN PATENT DOCUMENTS

| | | | |
|---|---|---|---|
| CN | 202253393 | U | 5/2012 |
| EP | 0354961 | A1 | 2/1990 |
| JP | 2001345001 | A | 12/2001 |
| JP | 2004119045 | A | 4/2004 |
| JP | 2006210042 | A | 8/2006 |
| KR | 200266609 | | 2/2002 |
| KR | 20120096245 | A | 8/2012 |
| TW | 201213727 | A | 4/2012 |
| WO | WO2012012966 | A1 | 2/2012 |

OTHER PUBLICATIONS

International Search Report and Written Opinion, issued in PCT Application No. PCT/US2013/043558, mailed Sep. 25, 2013, 9 pages.

International Search Report and Written Opinion, issued in PCT Application No. PCT/US2013/043560, mailed Aug. 27, 2013, 13 pages.

International Search Report and Written Opinion in PCT Application No. US2013/068946 dated Mar. 4, 2014.

* cited by examiner

INTEGRATED OPTIC AND BEZEL FOR FLASHLIGHT

TECHNICAL FIELD

The present disclosure relates to bezels and lenses for shaping a beam of light from a light source in a flashlight or other lighting unit, and more particularly, to integrated housing members and lens systems for flashlights.

BACKGROUND

Lenses for flashlights and other lighting units have been provided in a variety of forms, generally having in common a shape that is symmetrical about an axis along which the light is directed, e.g., the optical axis. Several such lenses have included a hole in a rear end of the lens adjacent a light source. Within the hole, the light source may be adjusted in position along the optical axis. Adjustment of the light source's position relative to the rear hole of the lens enables variance of a light beam emerging from a front face of the lens. Typically, lenses are limited in their capacity to combine a maximum intensity for a spot beam with a substantial uniformity for a wide beam.

Such lenses typically also were provided with a central convex lens surface on a front face combined with at least one additional convex surface where the light was either received into the lens, reflected within the lens, or emitted from the lens. Without being bound by theory, the additional convex surface may have been deemed necessary for a proper focusing of light from the source into a beam. Such lenses were alternatively provided with light-receiving, reflecting, and emitting surfaces that were flat as viewed in cross-section. Such flat surfaces were also likely deemed necessary for light-focusing or manufacturing purposes.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
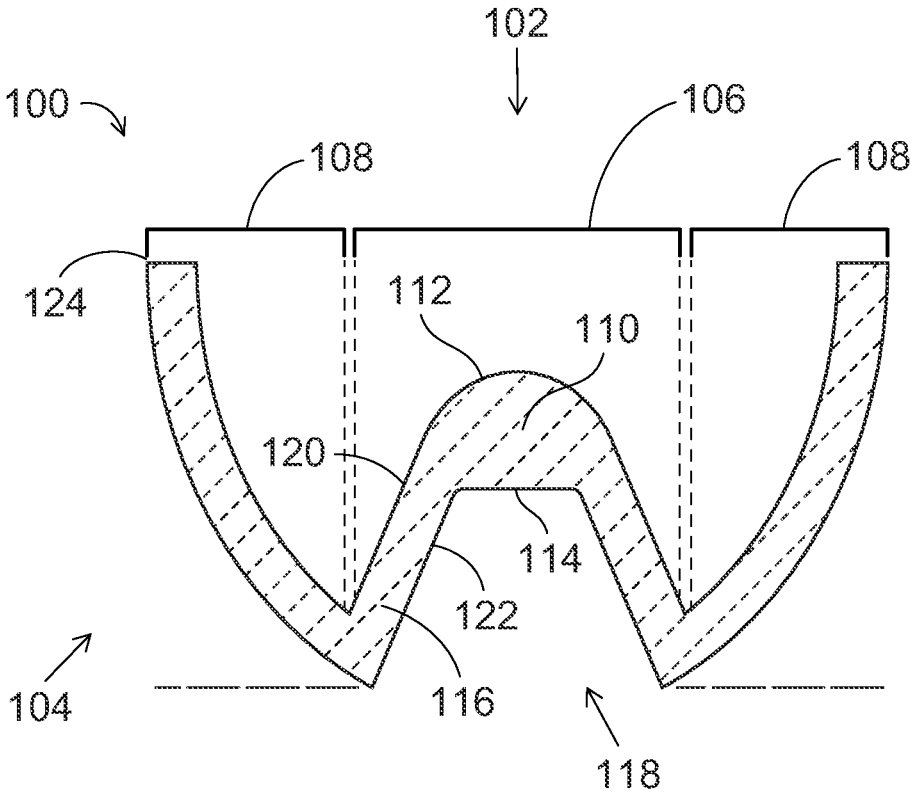
FIG. 1 is a cross-sectional view of one example of a lens body that may form a portion of an integrated lens and bezel (front portion of a housing member) system.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Embodiments herein provide one-piece, integrated bezel (e.g., a front portion of a housing member) and lens systems for flashlights and other devices. In some embodiments, the integrated bezel (front portion) and lens system may be combined with a light source and an adjustment mechanism, and it may be incorporated in a flashlight or other lighting unit and provide for focusing the light from the source. In other embodiments, the lens and bezel (front portion) may also be continuous with a body member that forms all or part of a housing for the flashlight. Such one-piece devices may provide a fixed-focus beam, whereas other one-piece devices may include an adjustment mechanism that permits adjustment of the light source relative to the lens, thus focusing the beam between a narrow or spot beam and a wide beam or flood light. In various embodiments, a light emitting diode or LED may be used as the light source, although other light sources, such as incandescent or fluorescent bulbs, may be used.

In some embodiments, the bezel (front portion of a housing member) of the flashlight may be continuous with the lens. In various embodiments, any lens suitable for shaping a beam in a desired manner may be used as a part of the integrated lens and bezel (front portion of a housing member) system. For example, in one embodiment the lens may be a one-piece focusing optic with a central focusing element, a side wall and annular ring portion having a thin profile, and a rear void for accommodating a light source. In another embodiment, the lens may be a thin-profile lens having a central focusing element and a thin-profile annular ring portion, and no rear void. Other embodiments may be simple bi-convex or bi-concave lenses. Still other lenses suitable for use as a component of the integrated lens and bezel (front portion of a housing member) system include conventional lenses that may include a front face, a rear LED-receiving void, and a side surface extending between the front face and the rear well.

In some embodiments, the system may include an adjustment mechanism for moving the light source relative to the lens or the lens relative to the light source. For example, in some embodiments, the lens may be continuous with the bezel (front portion), which may be adapted to couple to a body member that includes the LED fixed thereupon. In these embodiments, the distance between the lens and the LED may be adjusted by virtue of adjusting the position of the bezel (front portion) on the body member, for instance via a threaded coupling or one or more O-rings.

In other embodiments, the lens, bezel (front portion), and body member may be a single, unitary, integrated piece, and the body member may form all or part of a housing adapted to accommodate the LED or other light source. In some embodiments, the LED may be fixed with regard to the lens, and the flashlight may be configured to be a non-adjustable light, such as a wide beam or flood light or a focused beam flashlight. In other embodiments, the LED may be adjustable within the body member or housing, and an adjustment mechanism may be provided on an outside surface of the body member that permits adjustment of the position of the LED with respect to the lens.

In various embodiments, the central surface of the lens may be convex, and so may include a forward-most point, typically at the center of the surface. In various embodiments, the annular surface of the front face of the lens body may extend forward to a front rim that is farther forward than the forward-most point of the central surface, thus protecting the lens body from impact and abrasion. The lens body may further include an outer, front rim defining a chamfer between the annular surface and the side surface. In various embodiments, a rim may run around the rear well and the rear well adjacent the rear rim may be provided with a draft angle to facilitate removal from a mold.

As described above, a flashlight incorporating the lens system may include a housing structure in one or more portions that include the bezel (front portion of a housing member), and at least the bezel (front portion) may be continuous with the lens. The flashlight also may include an optional adjustment mechanism and an LED. In some embodiments, the lens, the optional adjustment mechanism, and all or part of the housing structure may be a single, integrated piece.

In various embodiments, the flashlight also may include a power supply, such as batteries or an AC-DC converter with electronics to condition a voltage waveform compatible with the LED. For example, in some embodiments, a pulse width modulator may be used to adjust the effective brightness of the LED.

In various embodiments, the lens body, bezel (front portion), and optionally, all or part of the body or housing may be formed of a single piece of solid, transparent material, such as polymethyl methacrylate (PMMA), molded or otherwise formed as a single piece. In some embodiments, the lens and bezel (front portion), or the lens, bezel (front portion), and all or part of the body or housing may be formed from a single piece of solid, injection-molded acrylic, or another suitable material, such as polycarbonate plastic. In other embodiments, the lens and bezel (front portion), or the lens, bezel (front portion), and all or part of the body or housing may be co-molded. Optionally, some portions of this integrated piece, such as the bezel (front portion) and/or reflector, may be tinted, painted, or coated, for example with a light-reflecting coating or an opaque coating to prevent light escape.

FIG. 1 shows one embodiment of a lens 100 that may form a portion of a single-piece, integrated lens and bezel (front portion of a housing member) system. The lens illustrated in FIG. 1 is described in greater detail in U.S. Provisional patent Ser. No. 13/490,278. Although only the lens 100 is illustrated in FIG. 1, it will be understood that lens 100 may form a part of a larger, unitary structure in some embodiments that may include, for example, a bezel (front portion) and optionally a body or housing member. In various embodiments, the lens body 100 may have a generally concave front face 102 and a generally convex rear face 104. In various embodiments, the lens body 100 may include a central portion 106, including a central focusing element 110 and a side wall 116, and an annular ring portion 108 surrounding the central portion 106.

In various embodiments, central portion 106 includes a central focusing element 110, which may be configured to direct light in a desired direction. In various embodiments, central focusing element 110 may include a convex front surface 112 and a flat rear surface 114, although in other embodiments, rear surface 114 may be flat or convex, depending on the desired focusing properties of the lens. In various embodiments, central focusing element 110 may be set off from annular ring portion 108 by a side wall 116 that may be configured to form a rear void 118 in the rear face 104 of the lens. In various embodiments, rear void 118 may be sized and shaped to accommodate a light source and/or at least of a portion of the light source base or pedestal (not shown). In various embodiments, side wall 116 may be flat as illustrated in FIG. 1, or it may have a slight elliptical curve, depending on the desired focusing properties of lens 100. Additionally, side wall 118 may have convex, flat, or concave front 120 and back 122 surfaces, as desired in order to achieve the desired light focusing properties. In one specific, non-limiting example, rear void 118 may have a substantially frustoconical shape.

In various embodiments, annular ring portion 108 may have a reflective front or back surface, and may be shaped in order to reflect light from the light source in a desired direction. In various embodiments, as described in greater detail below, central focusing element 110, side wall 116, and annular ring portion 108 may be configured to cooperate to direct light from a light source in a desired direction. Although a particular configuration of lens components is illustrated in FIG. 1, one of skill in the art will appreciate that other combinations of flat and/or curved lens surfaces may be substituted to fit a particular application and/or set of beam focusing requirements.

Additionally, although lens body 100 includes slight concavities and/or convexities in various portions, one of skill in the art will appreciate that the overall lens shape includes a generally concave front face 102, a generally convex rear face 104, a central focusing element 110, a side wall 116 configured to form a rear void 118, and an annular ring portion 108 configured to function as a reflector. Although the illustrated embodiment depicts central focusing element 110 as being continuous with side wall 116, one of skill in the art will appreciate that in other embodiments these features may be partially or completely discontinuous. In various embodiments, the overall thickness of the lens body 100, excluding central focusing element 110, when seen in cross section, is fairly uniform throughout lens body 100, despite being adapted to bend in and out of plane in order to achieve a desired focusing effect. In various embodiments, the thickness of lens body 100, excluding central focusing element 110, may vary less than about 10% over the entire width of lens body 100. For example, in one specific, non-limiting example, the thickness may vary by less than about 10% over the full width of lens body 100, excluding central focusing element 110, for example, 9%, 8%, 7%, 6%, 5%, 4%, 3%, 2%, 1%, or even 0%. In specific, non-limiting embodiments, a suitable lens thickness for a small-diameter lens may be about 2-3 mm, and a suitable thickness for a large-diameter lens may be 2-3 cm, or even more.

In various embodiments, central portion 106 may include a convex front surface 112 defining a forward-most point. In various embodiments, convex front surface 112 may incorporate any of various curvatures, and in some embodiments, the curvature may be substantially arcuate with a radius of no more than about 4 mm for a small-diameter flashlight having an overall lens diameter of less than about 2 cm, for example a lens having an overall diameter of about 12 mm. One of skill in the art will appreciate that this central portion diameter may be generally proportionately larger for larger diameter lenses. For example, a large diameter lens of 5-10 cm may have a central portion having a diameter of 1-4 cm, for example about 1.5-2.5 cm. The measurements described with reference to the embodiments of the lens are merely exemplary. Those of ordinary skill in the art will readily understand that other measurements may be used without deviating from the scope of the disclosure.

In various embodiments, annular ring portion 108 of lens body 100 may extend forward to front rim 124. In various embodiments, front rim 124 may extend farther forward than the forward-most point of central portion 106. In various embodiments, front rim 124 may include a chamfer between annular ring portion 108 and front rim 124 of at least about 0.2-0.5 mm of width for a small diameter flashlight. In some embodiments, the chamfer may have a width selected for a desired lens size and operational characteristics, and, as examples only, may be about 1.5 mm, about 2.0 mm, about 2.5 mm, or about 3.0 mm in width for a larger diameter lens.

Figure 2A:
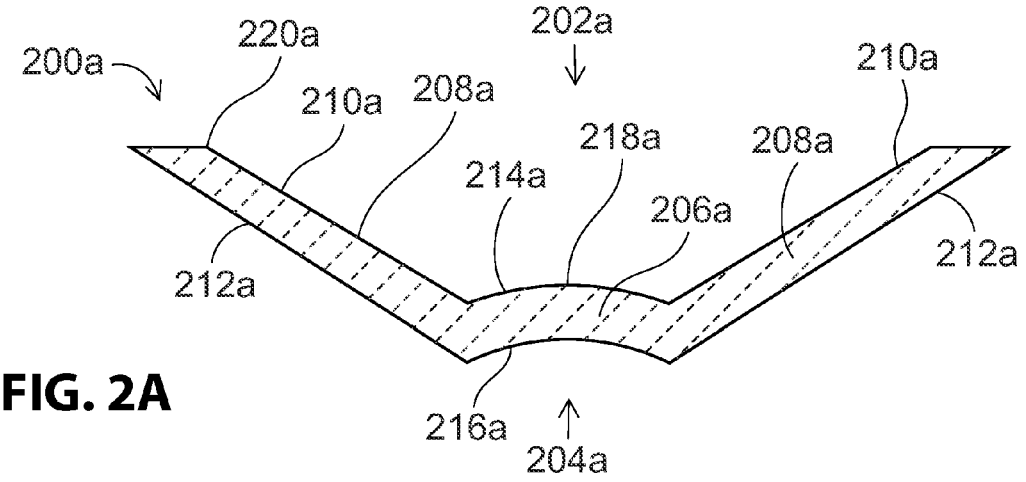
FIGS. 2A-2C illustrate cross-sectional views of three examples of thin-profile lens bodies that may form a portion of a lens and bezel (front portion of a housing member) system, including a thin-profile lens having a concave rear surface on the central portion of the lens (FIG. 2A), an example having a flat rear surface on the central portion of the lens (FIG. 2B), and an example having a convex rear surface on the central portion of the lens (FIG. 2C)
Figure 2B:
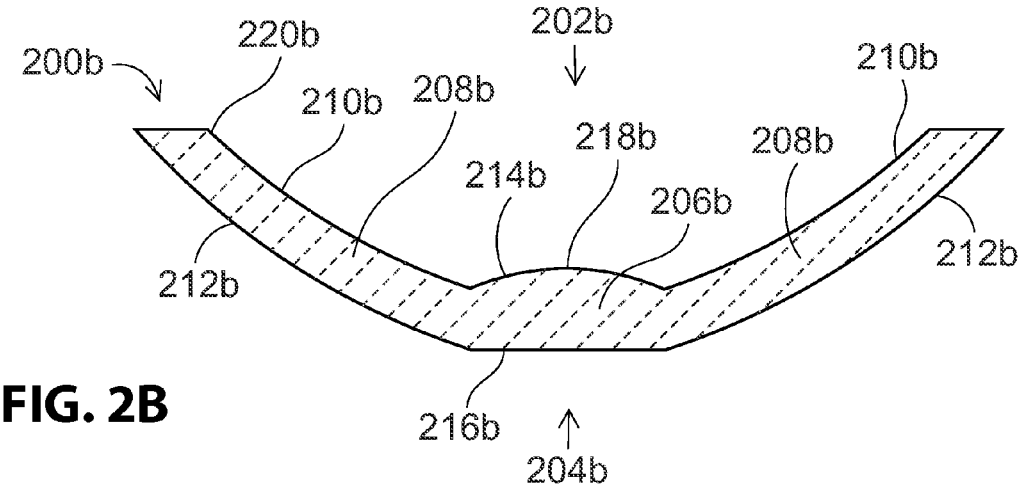
Figure 2C:
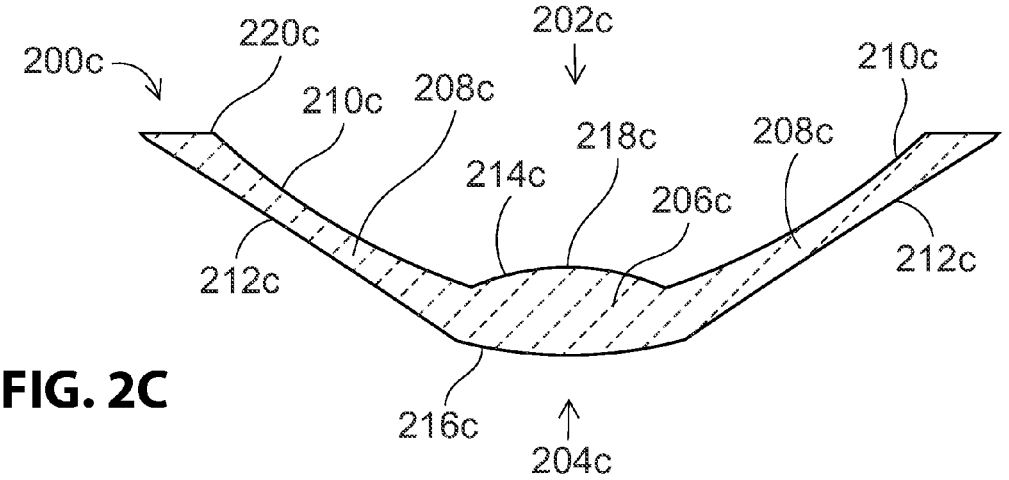

FIGS. 2A-2C illustrate cross-sectional views of three examples of thin-profile lens bodies, including a thin-profile lens having a concave rear surface on the central portion of the lens (FIG. 2A), an example having a flat rear surface on the central portion of the lens (FIG. 2B), and an example having a convex rear surface on the central portion of the lens (FIG. 2C), in accordance with various embodiments. The lenses illustrated in FIGS. 2A-2C are described in greater detail in U.S. Provisional patent Ser. No. 13/490,275. Although only the lenses 200*a*, 200*b*, 200*c* are illustrated in FIGS. 2A-2C, it will be understand that lenses 200*a*, 200*b*, 200*c* may form a part of a larger, unitary structure in some embodiments that may include, for example, a bezel (front portion) and optionally a body or housing member. Each lens 200*a*, 200*b*, 200*c* has a generally concave front face 202*a*, 202*b*, 202*c* and a generally convex rear face 204*a*, 204*b*, 204*c*. Each of the illustrated lens bodies 200*a*, 200*b*, 200*c* includes a central portion 206*a*, 206*b*, 206*c* and an annular ring portion 208*a*, 208*b*, 208*c* surrounding central portion 206*a*, 206*b*, 206*c*. In various embodiments, as described in greater detail below, these different lens portions may be configured to direct light from a light source in a desired direction. Although the illustrated lens bodies are shown as having two distinct light-directing portions, one of skill in the art will recognize that suitable thin-profile lenses also may be configured to have only one, or three, four, or more distinct light-directing portions.

In various embodiments, both central portion 206*a*, 206*b*, 206*c* and annular ring portion 208*a*, 208*b*, 208*c* may have a thin profile in cross-section, though both lens portions may have curved or flat front and rear surfaces. For example, in the example illustrated in FIG. 2A, central portion 206*a* has a convex front surface 214*a* and a concave rear surface 216*a*. Annular ring portion 208*a* has a flat front surface 210*a* and a flat rear surface 212*a*, and presents a generally flat profile in cross section.

In the example illustrated in FIG. 2B, central portion 206*b* has a convex front surface 214*b* and a flat rear surface 216*b*. Annular ring portion 208*b* has a concave front surface 210*b* and a convex rear surface 212*b*. As can be seen in FIG. 2B, annular ring portion 208*b* has a generally curved cross-sectional profile, as compared to the comparatively straight cross-sectional profile 208*a* shown in FIG. 2A.

In the example illustrated in FIG. 2C, central portion 206*c* has a convex front surface 214*c* and a convex rear surface 216*c*. Annular ring portion 208*c* has a concave front surface 210*c* and a flat rear surface 212*c*. As can be seen in FIG. 2C, annular ring portion 208*c* has a slightly curved cross-sectional profile, as compared to the comparatively straight cross-sectional profile 208*a* shown in FIG. 2A.

Although three examples of combinations of lens curvatures are illustrated in FIGS. 2A, 2B, and 2C, one of skill in the art will appreciate that other combinations of flat and/or curved lens surfaces may be substituted to fit a particular application and/or set of beam focusing requirements. Additionally, although lens bodies 200*a*, 200*b*, 200*c* include slight concavities and/or convexities in various portions, one of skill in the art will appreciate that the overall lens shape includes a concave front face, a convex rear face, and the overall thickness of the annular ring portion 208*a*, 208*b*, 208*c* (excluding the central portion 206*a*, 206*b*, 206*c*) when seen in cross section is fairly uniform throughout each lens body 200*a*, 200*b*, 200*c*. In various embodiments, the thickness may vary less than about 10%, such as 9%, 8%, 7%, 6%, 5%, 4%, 3%, 2%, 1% or even 0% over the entire width of annular portion 208*a*, 208*b*, 208*c*. In specific, non-limiting embodiments, a suitable lens thickness for the annular ring portion of a small-diameter lens may be about 2 mm, and a suitable thickness for the annular ring portion of a large-diameter lens may be 2-3 cm, or even more.

Additionally, all of the lens bodies illustrated in FIG. 2 lack the rear void or LED receiving well that flashlight lenses typically include. In fact, no portion of any of the lens bodies 200*a*, 200*b*, 200*c* is adapted to receive a LED light source or corresponding heat sink member within any portion of the lens body.

In various embodiments, central portion 206*a*, 206*b*, 206*c* may include a convex front surface 214*a*, 214*b*, 214*c*, defining a forward-most point 218*a*, 218*b*, 218*c*. In various embodiments, convex front surface 214*a*, 214*b*, 214*c* may incorporate any of various curvatures, and in some embodiments, the curvature may be substantially arcuate with a radius of no more than about 2-4 mm for a small-diameter flashlight having an overall lens diameter of less than about 1 cm, for example a lens having an overall diameter of about 6-8 mm. One of skill in the art will appreciate that this central portion diameter may be generally proportionately larger for larger diameter lenses. For example, a large diameter lens of 5-10 cm may have a central portion having a diameter of 1-4 cm, for example about 1.5-2.5 cm. The measurements described with reference to the embodiments of the lens are merely exemplary. Those of ordinary skill in the art will readily understand that other measurements may be used without deviating from the scope of the disclosure.

In various embodiments, annular ring portion 208*a*, 208*b*, 208*c* of lens body 200*a*, 200*b*, 200*c* may extend forward to front rim 220*a*, 220*b*, 220*c*. In various embodiments, front rim 220*a*, 220*b*, 220*c* may extend farther forward than forward-most point 218*a*, 218*b*, 218*c* of central portion 206*a*, 206*b*, 206*c*. In various embodiments, front rim 220*a*, 220*b*, 220*c* may include a chamfer between annular ring portion 208*a*, 208*b*, 208*c* and front rim 220*a*, 220*b*, 220*c* of at least about 0.2-0.5 mm of width for a small diameter flashlight. In some embodiments, the chamfer may have a width selected for a desired lens size and operational characteristics, and, as examples only, may be about 1.5 mm, about 2.0 mm, about 2.5 mm, or about 3.0 mm in width for a larger diameter lens.

Figure 3A:
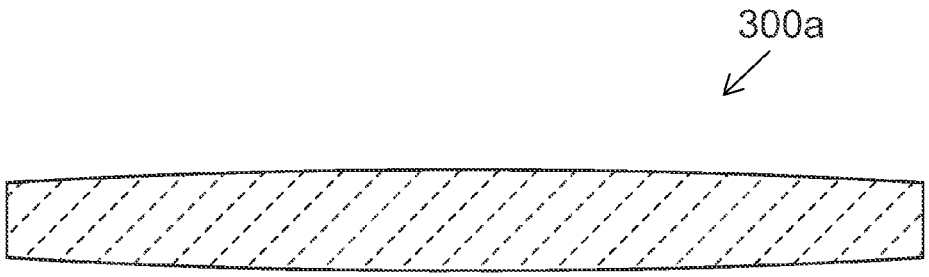
FIGS. 3A and 3B are cross-sectional views of a bi-convex lens (FIG. 3A) and a bi-concave lens (FIG. 3B), either of which may form a portion of an integrated lens and bezel (front portion of a housing member) system.
Figure 3B:
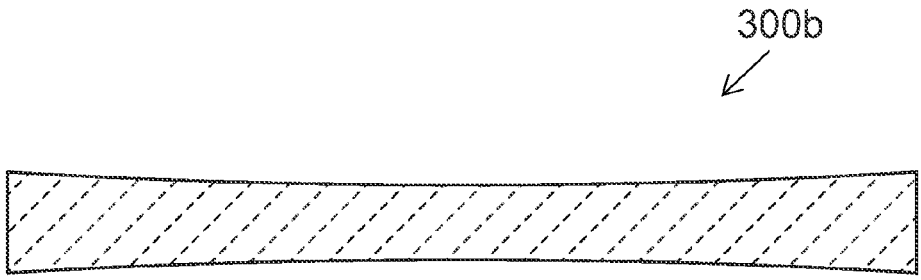

FIGS. 3A and 3B are cross-sectional views of a bi-convex lens (FIG. 3A) and a bi-concave lens (FIG. 3B), and both are examples of additional lens bodies that may form a part of an integrated bezel (front portion of a housing member) and lens system in accordance with various embodiments. In these embodiments, the lens 300*a*, 300*b* may be a simple bi-convex or bi-concave lens, with no additional central focusing elements. Although only the lenses 300*a*, 300*b* are illustrated in FIGS. 3A and 3B, it will be understand that lenses 300*a*, 300*b* may form a part of a larger, unitary structure in some embodiments that may include, for example, a bezel (front portion) and optionally a body or housing member.

Figure 4A:
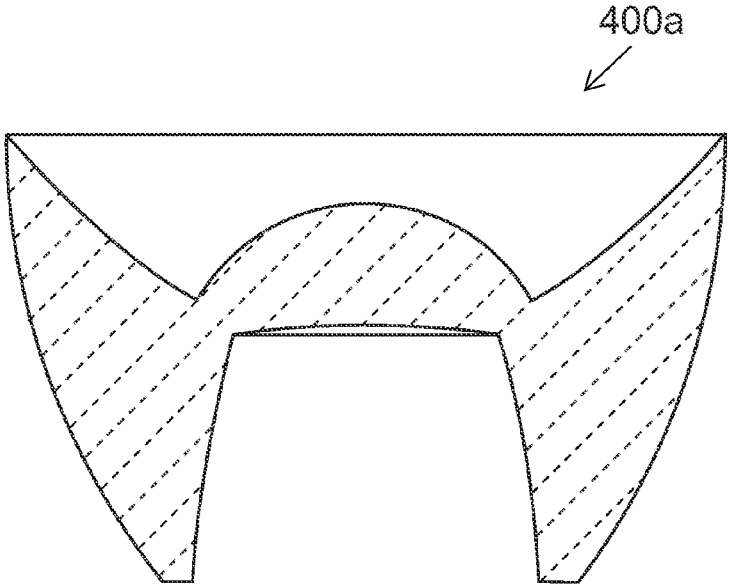
FIG. 4 is a cross-sectional view of another lens that may form a portion of an integrated lens and bezel (front portion of a housing member) system.
Figure 4B:
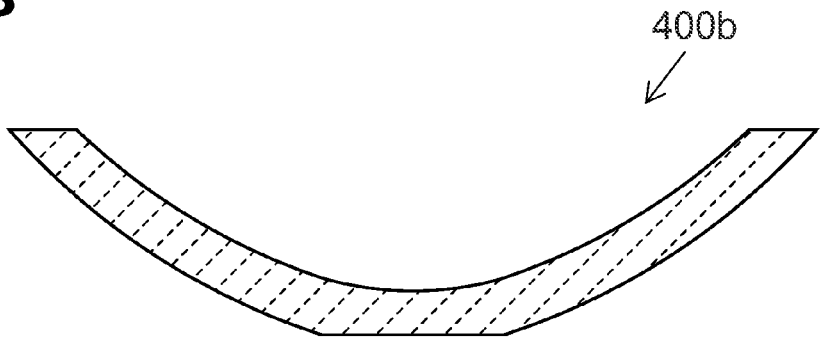
Figure 4C:
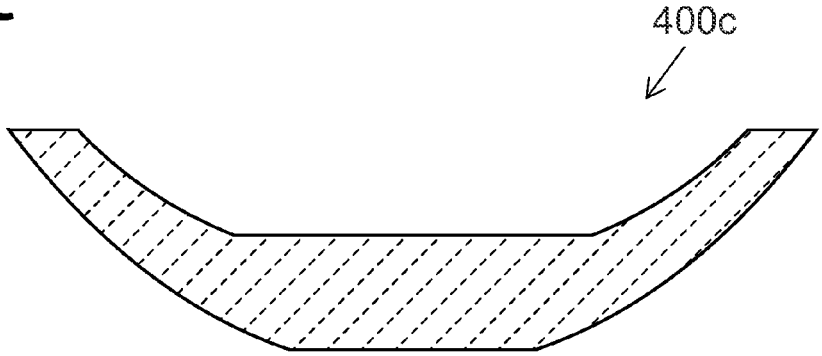

FIG. 4 is a cross-sectional view of a traditional lens 400 that may be used as a part of an integrated bezel (front portion of a housing member) and lens system in various embodiments. In various embodiments, this lens may have an overall thicker profile than some of the thin-profile lenses described for use herein. Although only the lens 400 is illustrated in FIG. 4, it will be understand that lens 400 may form a part of a larger, unitary structure in some embodiments that may include, for example, a bezel (front portion) and optionally a body or housing member.

Figure 5A:
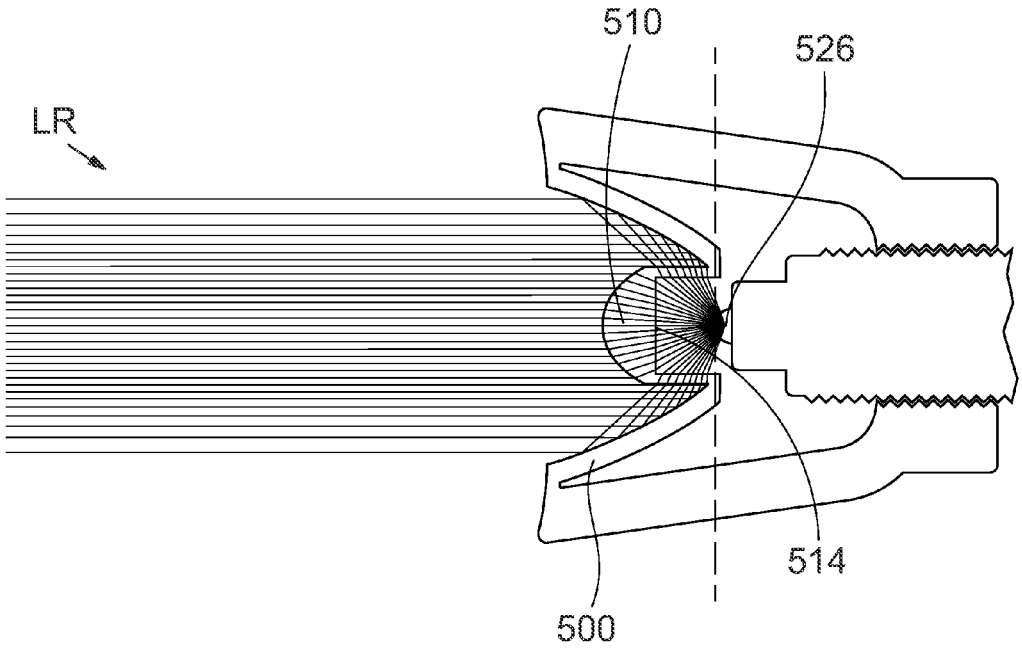
FIGS. 5A and 5B show the light refraction and reflection to form varying beams (FIG. 5B wide or flood beam and FIG. 5A narrow or spot beam) as the light source is moved in the rear well of the exemplary lens body illustrated in FIG. 1.
Figure 5B:
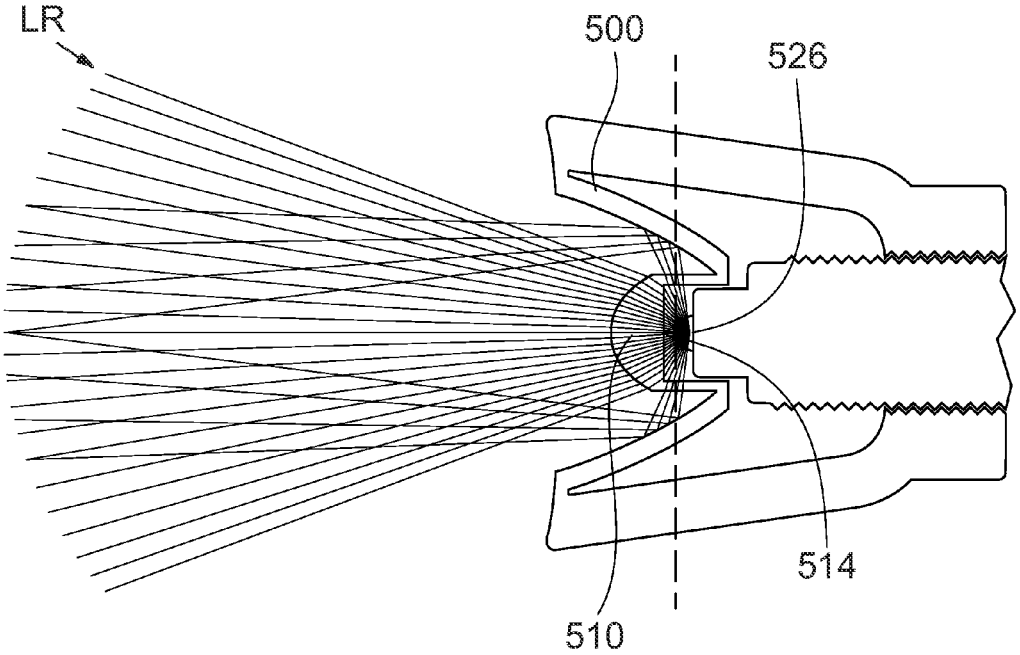

As best seen in FIGS. 5A and 5B, in various embodiments, adjustment of the LED position relative to the lens may provide a beam ranging between a wide beam or flood light (see, e.g., FIG. 5B) and a narrow or spot beam (see, e.g., FIG. 5A). In various embodiments, a spot beam may provide about +/−3° of angular distribution at about 50% of maximum intensity. An example of a wide beam is a distribution with an angular range of about +/−45° over which the intensity is at least about 50% of the maximum or on-axis value. In accordance with various embodiments, the light may be varied from spot beam to wide beam with the adjustment in position of the LED being no more than about 3-50 mm, depending on the lens diameter. A representation of the light rays LR calculated for an example of a lens and LED configuration is shown in each of FIGS. 5A and 5B. As illustrated, in various embodiments, lens 500 may direct a substantial portion of light rays LR into the desired beam and a smaller portion of light rays LR may be expected to travel outside the desired beam.

Figure 6A:
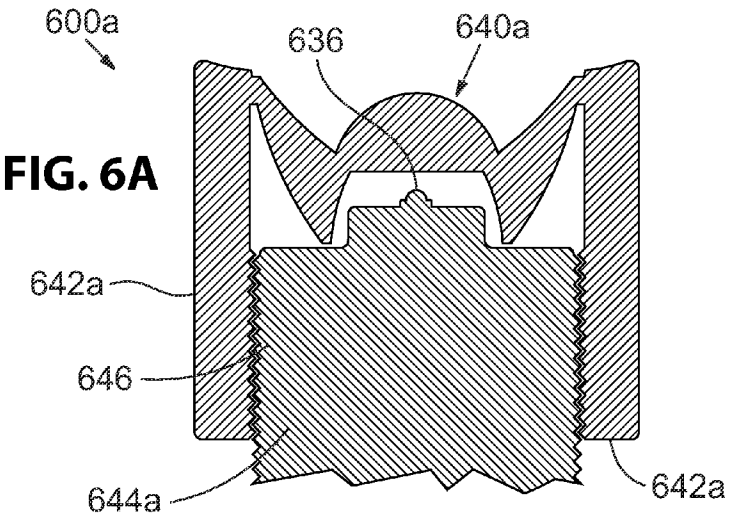
FIGS. 6A-6D are four cross-sectional views of an integrated bezel (front portion of a housing member) and lens system for a flashlight, showing a threaded adjustable bezel (front portion of housing member) with the light source in a wide beam or flood position (FIG. 6A) and a narrow or spot beam position (FIG. 6B), and a slidably-adjustable bezel (front portion of housing member) with the light source in a wide beam or flood position (FIG. 6C) and in a narrow or spot beam position (FIG. 6D)
Figure 6B:
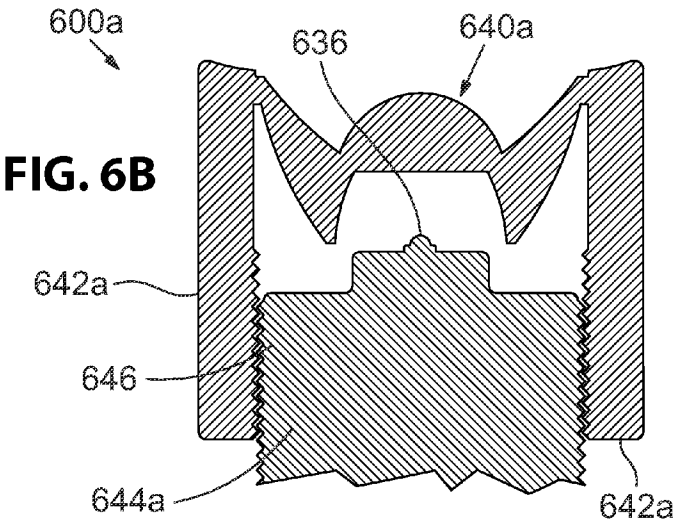

FIGS. 6A-6D are four cross-sectional views of an integrated bezel (front portion of a housing member) and lens system for a flashlight, showing a threaded adjustable bezel (front portion) with the light source in a wide beam or flood position (FIG. 6A) and a narrow or spot beam position (FIG. 6B), and a slidably-adjustable bezel (front portion) with the light source in a wide beam or flood position (FIG. 6C) and in a narrow or spot beam position (FIG. 6D), in accordance with various embodiments. As illustrated, in various embodiments, as shown in FIGS. 6A and 6B, the integrated bezel (front portion) and lens system 600*a* may include a lens 640*a* and a bezel (front portion) 642*a* that may be continuous with one another, forming a single, integrated component. In some embodiments, bezel (front portion) 642*a* may be configured to couple to a body member 644*a*, which may include a light source, such as LED 636. In some embodiments, system 600*a* may also include an adjustment mechanism, such as a threaded coupling or engagement 646 between bezel (front portion) 642*a* and body member 644*a*, which may permit adjustment of the spacing between the light source and the lens, thus enabling focusing of the resulting light beam as described in detail above.

Figure 6C:
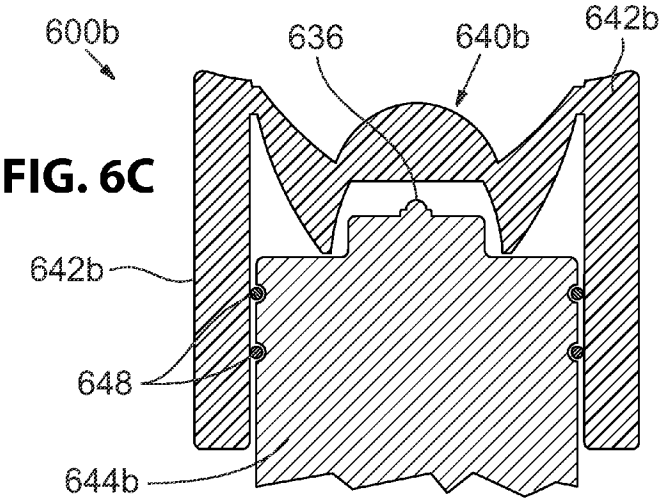
Figure 6D:
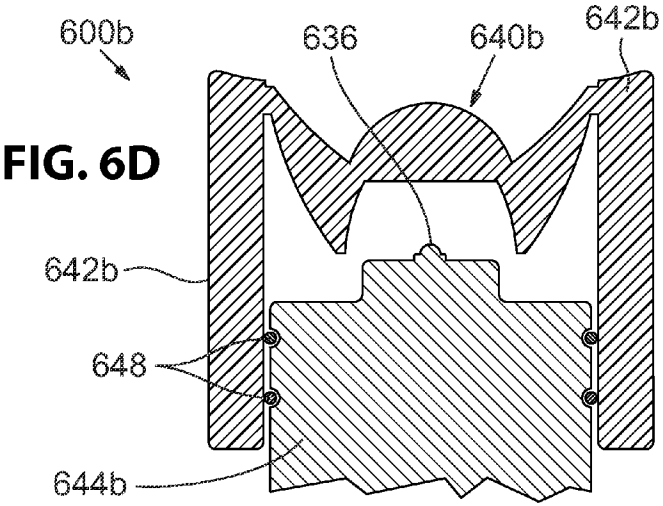

In other embodiments, as shown in FIGS. 6C and 6D, the integrated bezel (front portion of a housing member) and lens system 600*b* may include an integrated, one-piece lens 640*b* and bezel (front portion) 642*b* may be slidably mounted on body member 644*b*. In some embodiments, the slidable mount may include one or more O-rings 648 that may facilitate adjustment of bezel (front portion) 642*b* on body member 644*b*, which may permit adjustment of the spacing between LED 636 and lens 640*b*, thus enabling focusing of the resulting light beam, for instance to produce a spot beam or a flood beam. Although threaded and slidable mounts are illustrated, one of skill in the art will appreciate that other suitable mechanism allowing a user to adjust the relative positions of the lens and light source may be used, for example those involving various slots and tabs, or any other mechanism that may allow for adjustment of the relative positions of lens and/or light source.

In various embodiments, integrated bezel (front portion of a housing member) and lens system 600*a*, 600*b* may be adjusted with the adjustment mechanism as described in order to provide a light beam with a wide beam having a distribution with an angular range of about +/−45° over which the intensity is at least 50% of the maximum or on-axis value. For that wide beam, integrated bezel (front portion) and lens system 600*a*, 600*b* may provide a substantially uniform intensity between at least about +/−10° of angular distribution. In various embodiments, system 600*a*, 600*b* also may provide an increased intensity for the spot beam as compared to a similar lens incorporating one or more flat or convex surfaces among its rear well sidewall, rear well base, front annular surface, and/or side surface.

In some embodiments, bezel (front portion) 642 may be provided with a grip-enhanced region, such as a region having grooves, ridges, swellings, textures, or the like, which may extend partially or completely around bezel (front portion) 642. In various embodiments, the grip-enhanced region may aid a user, e.g., in a one-handed adjustment of the focus of the beam by providing a convenient grip for the thumb and forefinger on bezel (front portion) 642 while body member 644 is gripped by the other three fingers. In some embodiments, a control button may be provided on the flashlight body, e.g., at an end opposite bezel (front portion) 642, or on bezel (front portion) 642 itself.

In various embodiments, body member 644 or other housing structures may be made from a metal such as aluminum or steel or a plastic such as ABS. Component materials may be selected to be compatible with lighting unit operation in harsh environments such as very high or very low ambient temperatures.

Figure 7B:
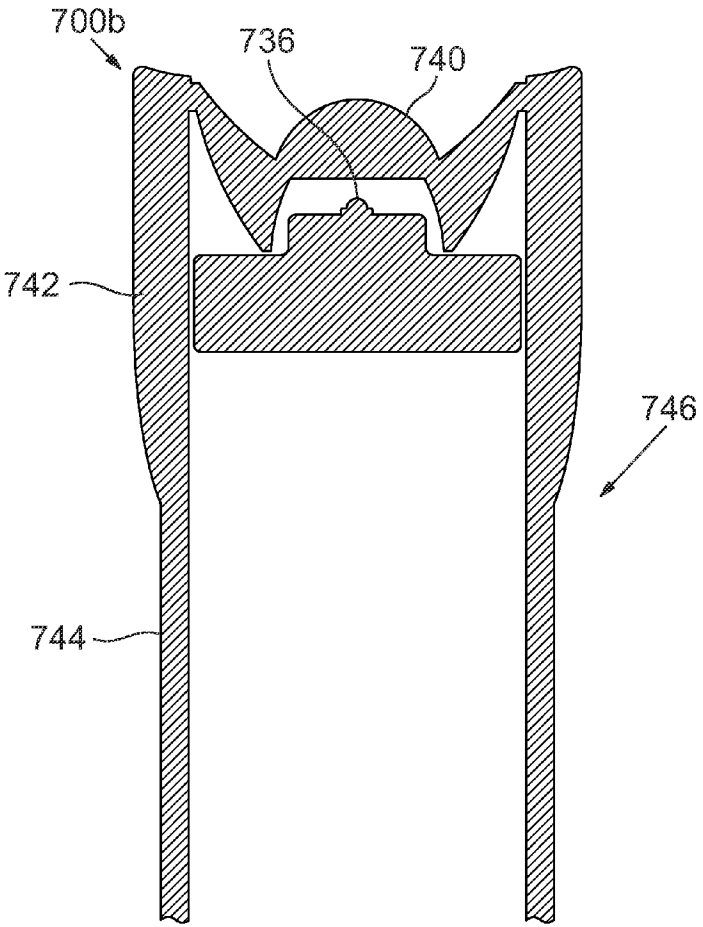
FIGS. 7A and 7B show two cross-sectional views of fixed-focus flashlights configured for a wide beam (FIG. 7A) and a narrow or spot beam (FIG. 7B), each having a one-piece integrated lens system, bezel (front portion of housing member), and housing body.
Figure 7A:
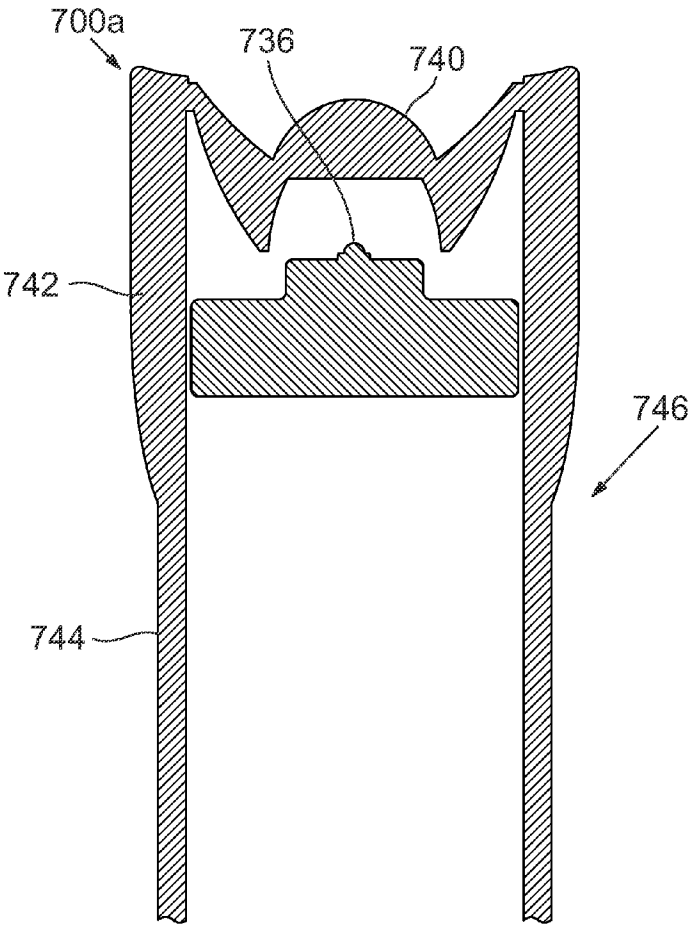

FIGS. 7A and 7B show two cross-sectional views of fixed-focus flashlights configured for a wide beam (FIG. 7A) and a narrow or spot beam (FIG. 7B), each having a one-piece integrated lens system, bezel (front portion), and housing, in accordance with various embodiments. In the illustrated embodiments, system 700 includes a lens 740, bezel (front portion) 742, and body member 744 that are all one integrated, continuous piece, such a piece of injection-molded acrylic. Together, bezel 742 (front portion) and body member 744 form a continuous housing 746 for the flashlight. In the embodiment illustrated in FIG. 7A, an LED 736 is disposed within the housing 746 in a position configured to produce a flood or wide beam. By contrast, in the embodiments illustrated in FIG. 7B, an LED 736 is disposed within housing 746 in a position configured to produce a spot or narrow beam. Neither embodiment includes an adjustment mechanism; the LED is fixed in place. In various embodiments, electronics, batteries, and interconnections (not shown) may be provided in body member 744 of housing 746. In some embodiments, an interior surface of housing 746 may include a threaded engagement for receiving a mount 748 for LED 736.

Figure 8B:
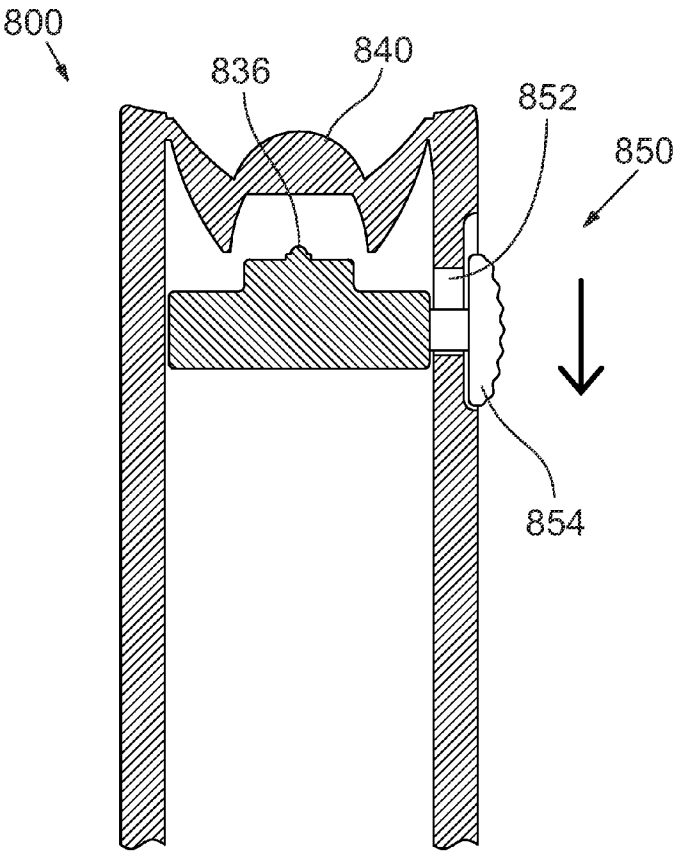
FIGS. 8A and 8B illustrate two views of an adjustable focus flashlight having a one-piece integrated optics system, bezel (front portion of housing member), and housing body, including cross-sectional views of the flashlight with the light source in a wide beam or flood position (FIG. 8A) and with the light source in a narrow beam or spot beam position (FIG. 8B), in accordance with various embodiments.
Figure 8A:
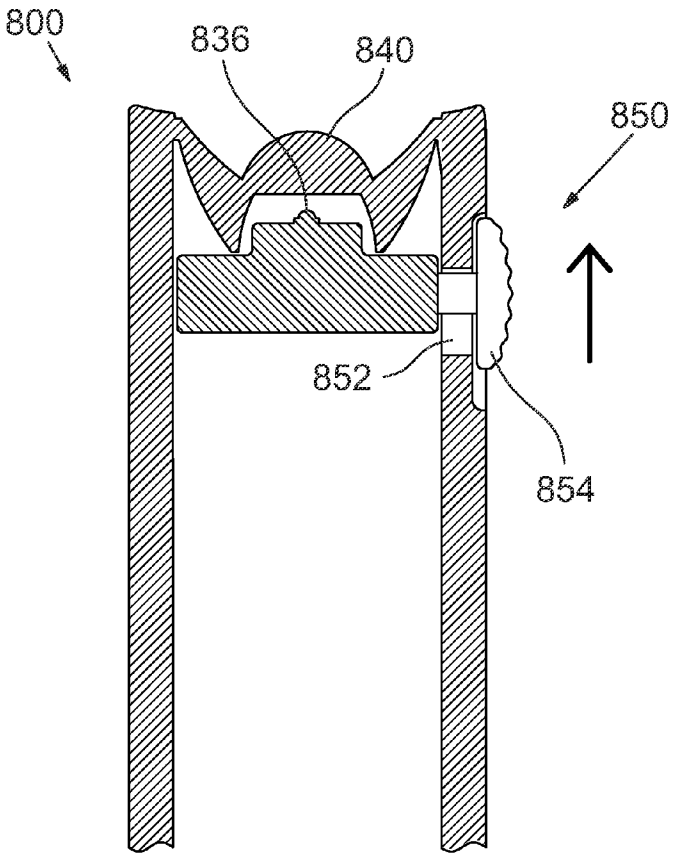

FIGS. 8A and 8B illustrate two views of an adjustable focus flashlight having a one-piece integrated optics system, bezel (front portion), and housing, including cross-sectional views of the flashlight with the light source in a wide beam or flood position (FIG. 8A) and with the light source in a narrow beam or spot beam position (FIG. 8B), in accordance with various embodiments. The embodiment illustrated in FIG. 8 is similar to those illustrated in FIG. 7, except that the embodiment illustrated in FIG. 8 includes an adjustment mechanism 850 for adjusting the position of LED 836 relative to lens 840, thus changing the focus of the light beam between a wide beam or flood light (FIG. 8A) and a narrow beam or spot light (FIG. 8B) as described above in greater detail. In the illustrated embodiment, adjustment mechanism 850 includes a longitudinal slot 852, thought which a tab or lever 854 may protrude. In use, a user may slide lever 854 forward in longitudinal slot 852, towards bezel (front portion) 842 and lens 840, thus decreasing the distance between LED 836 and lens 840, and adjusting the light beam to a flood or wide beam. Conversely, the user may slide lever 854 back and away from bezel (front portion) 842 and lens 840 within longitudinal slot 852, thus focusing the light beam to a narrow beam or spot light.

Although a lever and slot adjustment mechanism is illustrated, one of skill in the art will appreciate that any other adjustment mechanism may substituted that allows a user to adjust the distance between lens 840 and LED 836. For example, although a longitudinal adjustment slot is illustrated in FIG. 8, one of skill in the art will appreciate that a slot that is slanted or diagonal with respect to the longitudinal axis of the flashlight may be substituted. For example, in one embodiment, the tab(s) that protrudes from a slanted slot(s) may rest inside a groove that is on the underside of a separate external ring around the flashlight body. In this embodiment, when the external ring is twisted relative to the body of the flashlight, the LED will move longitudinally relative to the optic. In another embodiment, the external ring may have one or more small tabs integrated therein, and those tabs may ride in slanted (e.g., diagonal) slots on the LED heatsink assembly inside the flashlight.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. An integrated lens and housing system for a flashlight, comprising:

a housing including a front portion and a body portion, a focusing lens comprising:

a central focusing element that directs a light beam in a desired direction; and an annular ring portion surrounding the central focusing element, wherein the annular ring portion reflects light in a desired direction;

wherein the focusing lens and the front portion together comprise a unitary component formed from a single piece of solid, transparent material; and a light source disposed within the housing, wherein the light source interacts with the focusing lens to provide the light beam, and wherein a distance between the focusing lens and the light source is slidably adjustable to selectably focus the light beam.

2. The integrated lens and housing system of claim 1, wherein the front portion is configured to move relative to the body portion.

3. The integrated lens and housing system of claim 1, wherein the front portion is configured to move relative to the body portion, and wherein movement of the front portion relative to the body portion alters a focus of the light beam.

4. The integrated lens and housing system of claim 3, wherein the housing comprises an adjustment mechanism coupling the front portion to the body portion.

5. The integrated lens and housing system of claim 4, wherein the front portion is slidably coupled to the body portion.

6. The integrated lens and housing system of claim 1, wherein the housing comprises a coupling mechanism comprising one or more slidable connectors.

7. The integrated lens and housing system of claim 6, wherein the one or more slidable connectors comprise one or more O-rings.

8. The integrated lens and housing system of claim 1, wherein the lens, the front portion, and the body portion together comprise a single, continuous component.

9. The integrated lens and housing system of claim 1, wherein the housing comprises a slot and a tab protruding therethrough, and wherein adjustment of a longitudinal position of the tab within the slot adjusts a focus of the light beam.

10. The integrated lens and housing system of claim 9, wherein adjustment of the longitudinal position of the tab towards the focusing lens produces a wider light beam.

11. The integrated lens and housing system of claim 10, wherein the slot is a longitudinal or diagonal slot.

12. The integrated lens and housing system of claim 10, wherein adjustment of the longitudinal position of the tab away from the focusing lens produces a narrower light beam.

13. A method of making a flashlight, the method comprising:

molding a first component from a single, transparent material, wherein the first component comprises a focusing lens and a first housing member; the focusing lens comprising:

a central focusing element that directs a light beam in a desired direction; and an annular ring portion surrounding the central focusing element, wherein the annular ring portion reflects light in a desired direction; wherein the focusing lens is configured to selectably focus the light beam into a spot beam and a flood beam;

coupling the first component to a second component, wherein the second component comprises a light source, a power source, one or more electric conduits, and a switch member, such that the distance between the focusing lens and the light source is slidably adjustable to select the spot beam or the flood beam.

14. The method of claim 13, wherein the second component comprises a second housing member adapted to couple to the first housing member.

15. The method of claim 13, wherein the second component is adapted to fit at least partially within the first housing member.

16. The method of claim 13, wherein molding comprises injection-molding or co-molding.

17. The integrated lens and housing system of claim 1 wherein the distance between the focusing lens and the light source is longitudinally adjustable to selectively focus the light beam.

18. The method of claim 13 wherein the coupling of the first component to a second component is performed such that the distance between the focusing lens and the light source is longitudinally adjustable to select the spot beam or the flood beam.

* * * * *